US006675858B2

(12) United States Patent
Marocco

(10) Patent No.: US 6,675,858 B2
(45) Date of Patent: Jan. 13, 2004

(54) VERTICAL BLIND WITH FABRIC WRAP

(75) Inventor: Norbert Marocco, Woodbridge (CA)

(73) Assignee: Shade-O-Matic Limited, Toronto (CA)

( * ) Notice: Subject to any disclaimer, the term of this patent is extended or adjusted under 35 U.S.C. 154(b) by 8 days.

(21) Appl. No.: 10/008,942

(22) Filed: Dec. 3, 2001

(65) Prior Publication Data

US 2003/0102090 A1 Jun. 5, 2003

(51) Int. Cl.[7] ..... A47H 1/00
(52) U.S. Cl. ..... 160/89; 160/84.01; 160/168.18
(58) Field of Search ..... 160/84.01, 89, 160/166, 168.1, 178.1, 236, 345, 900; 16/87.2, 87.4 R

(56) References Cited

U.S. PATENT DOCUMENTS

| | | | | |
|---|---|---|---|---|
| 3,851,699 A | | 12/1974 | Shapiro | |
| 4,582,109 A | * | 4/1986 | Fairbanks | 160/84 R |
| 5,012,552 A | | 5/1991 | Wulf | 16/87.4 |
| 5,297,607 A | | 3/1994 | Beauchamp | 160/84.1 |
| 5,323,834 A | * | 6/1994 | Toti | 160/84.1 |
| 5,392,833 A | | 2/1995 | Ohanesian | 160/89 |
| 5,439,042 A | | 8/1995 | Ohanesian | 160/89 |
| 5,603,369 A | * | 2/1997 | Colson et al. | 160/84.06 |
| 5,715,883 A | | 2/1998 | Keith | |
| 5,749,404 A | | 5/1998 | Colson | 160/84.04 |
| 5,937,927 A | | 8/1999 | Keith | |
| 6,098,246 A | | 8/2000 | Moir | 16/97.2 |
| 6,186,213 B1 | | 2/2001 | Senesac | 160/89 |
| 6,257,300 B1 | * | 7/2001 | Brownlie | 160/84.01 |
| 6,334,477 B1 | | 1/2002 | Moir | |

FOREIGN PATENT DOCUMENTS

| | | | |
|---|---|---|---|
| CA | 2276387 | 6/2000 | A47H/13/12 |

OTHER PUBLICATIONS

International Search Report, dated Jul. 17, 2001. PCT patent application Ser. No. PCT/US01/40534, filed Apr. 17, 2001.

* cited by examiner

*Primary Examiner*—Bruce A. Lev
(74) *Attorney, Agent, or Firm*—Ohlandt, Greeley, Ruggiero&Perle LLP

(57) ABSTRACT

A vertical blind having a head rail, one or more trolleys being movable along the head rail and blind slats being suspended therefrom. The vertical blind has a fabric panel with folds enfolding the blind slats. The vertical blind has attachments by which the fabric panel is secured to the upper ends of the blind slats and at least partially enfolds the blind slats, without requiring modification of the trolleys. A kit or attachment to the blind slats of an existing vertical blind has panel clip attachments being on an upper end of a fabric panel, and panel clips each being mounted to the upper edge of each blind slat to straddle over and hang on both sides of the upper edge of each of the blind slats.

23 Claims, 8 Drawing Sheets

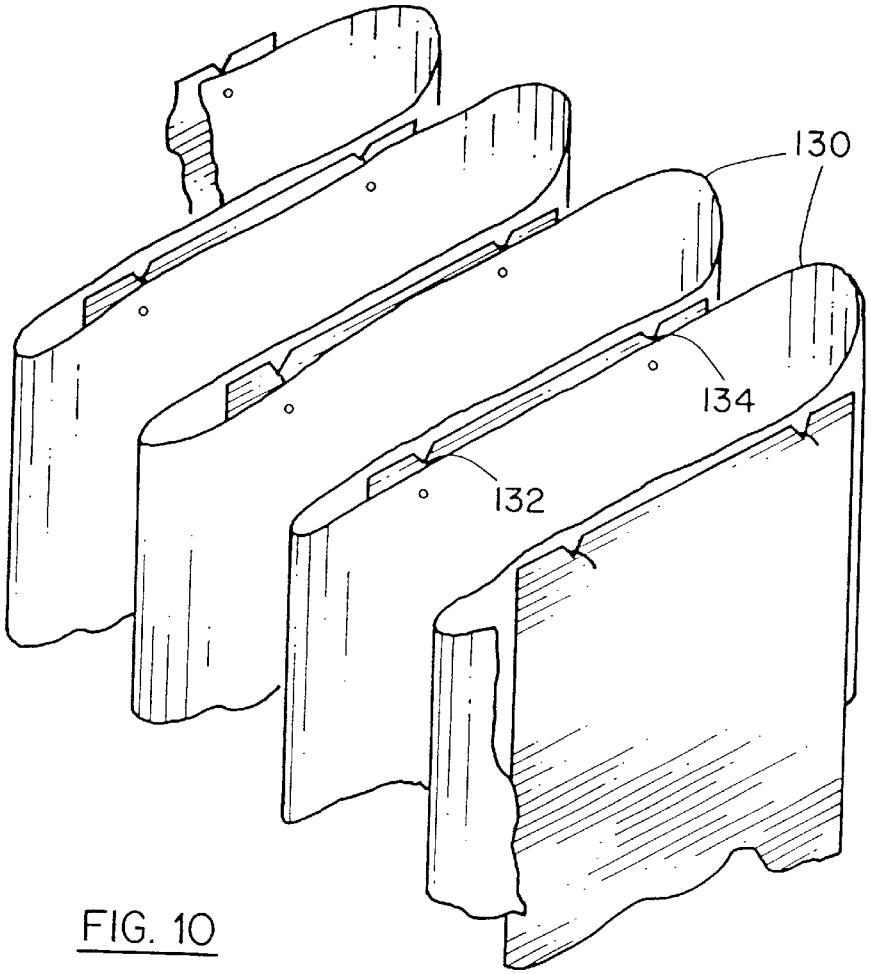
FIG. 10
FIG. 11
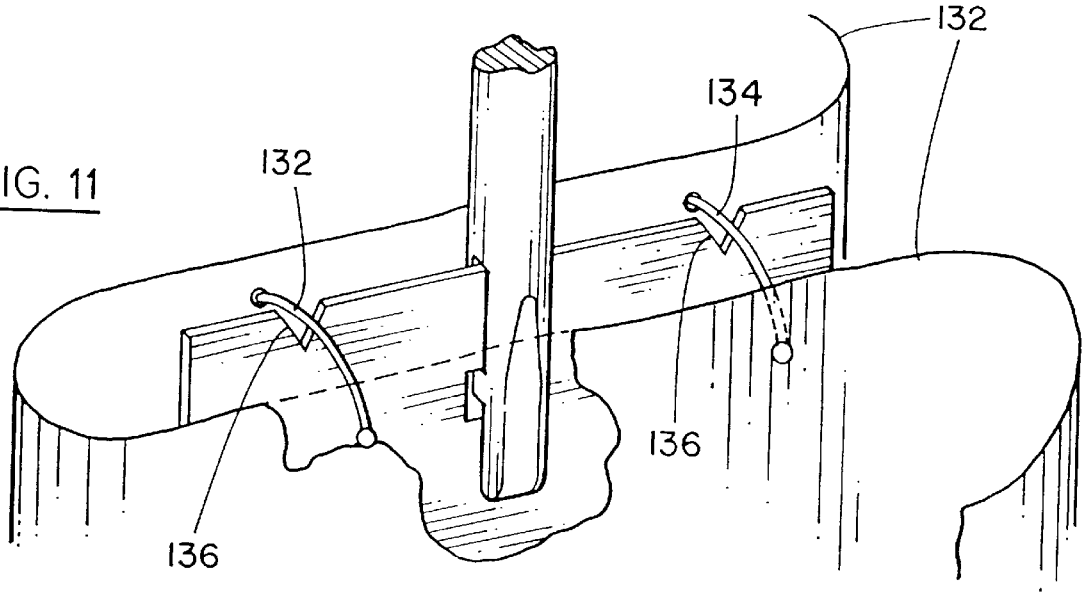

VERTICAL BLIND WITH FABRIC WRAP

BACKGROUND OF THE INVENTION

1. Field of the Invention

The present invention relates to vertical blinds of the type having a head rail and vertical blind slats suspended from the head rail and in particular to such a vertical blind having a fabric wrap arranged around the blind slats.

2. Description of the Prior Art

Blinds such as horizontal or "venetian" blinds, and also vertical blinds are well known. Both such blinds have slats which can be turned between open and closed positions. When closed, the interior space is not visible from the outside, thus ensuring privacy.

However, little or no exterior light can then penetrate the interior. When the slats are rotated open, light can enter, but much of the privacy is lost. Persons walking by outside can see some of the interior space by peering between the open slats. In recent years, a variation has been developed in which the blind slats are wrapped or shrouded in fabric. Usually, the fabric is a lightweight net or gauze sheer type of fabric. Such sheer fabric is designed to let the light pass through when the slats are open but it prevents viewing from outside the building, through the fabric. Thus, such fabric adds greater privacy to the blind enclosed area even when the blind is open. The fabric does not however prevent the slats from being rotated closed to exclude exterior light if that is desired.

Various different designs have been proposed, but most of them require special modification by the manufacturer, during fabrication of the blind. This means that either a store must carry a very large inventory of blinds, both with and without fabric blind wraps, or in the alternative the customer must place a special order and wait for delivery at a later date.

Many of these earlier designs were based on the principle of using two spaced apart panels of fabric, one panel being located on, and secured to one side or edge of the slats, and the other panel on the other side or edge of the slats.

The result was a series of rectangular tubes known as a "honeycomb" structure. This was relatively complex and expensive to make. It was not adaptable to combination with an existing blind consisting of plain slats, without a fabric wrap. Such a blind had to be manufactured specially, and was usually available only on order.

It has been found that this complex structure is substantially unnecessary to achieve the objective of increasing privacy while still permitting light to pass through the blind.

A single panel of fabric, wrapped around one side or edge only of each slat is now found to be entirely adequate for the purpose of privacy, and permits the passage of exterior light into the building. This single panel wrap fabric results in a much lower cost to the consumer. The end effect has an aesthetic appeal to the eye, being somewhat looser than the semi-rigid form of "honeycomb" structure, and has more of the appearance of an elegant shear drape, covering the blind slats, rather than a series of honeycomb box structures.

Preferably the blind wrap fabric should be capable of being attachable by the customer directly to a regular non-wrapped blind, or in some cases it may be attached to a regular non-wrapped blind by store service personnel at the time of purchase.

In this way, the regular non-wrapped blinds can be kept in stock in the retail store. If a customer requests a wrapped or shrouded blind then an existing in store blind can be fitted there and then with the fabric wrap, and supplied to the customer in a few minutes.

Preferably also the fabric wrap may be supplied as a kit, consisting of the fabric panel and system of attachments or clips by which the fabric panel can be easily attached as a retro fit, in some cases, to a blind which may have been purchased and installed some time earlier.

Preferably the fabric panel may even be capable of being removed and replaced if necessary. This also enables the store to carry fabric wrap kits for vertical blinds in a variety of shades, to give a customer a choice for selection, so as to match the blinds being purchased.

SUMMARY OF THE INVENTION

With a view to achieving a solution to at least some of these problems, the invention provides a fabric wrapped vertical blind, of the type having a head rail and blind slats suspended therefrom by their ends, in which the slats can be moved along the head rail, drawing them to one side of the door or window, like a drape, and in which the slats, when drawn across the door or window, can be rotated between open or closed, positions, and having a fabric panel, and panel attachments on said blind slats, and said fabric panel being secured to said panel attachments and at least partially enfolding said blind slats.

The invention further seeks to provide such a fabric wrapped vertical blind, wherein said fabric panel is secured to said attachments by an upper edge of said panel, said panel being thereby suspended from said upper edge, in folds around said blind slats.

The invention further seeks to provide such a fabric wrapped vertical blind, wherein said attachments are secured to upper edges of said blind slats.

The invention further seeks to provide such a fabric wrapped vertical blind, wherein said attachments comprise clips secured to an upper edge of said blind slats, and friction fasteners incorporated in said clips, and complementary friction fasteners on said fabric panel.

The invention further seeks to provide such a fabric wrapped vertical blind, wherein said blind slats are carried on moveable trolleys moving in said head rail, and including suspension stems extending down from said trolleys and engaging respective said blind slats, and said attachments defining attachment body portions, and openings in said body portions through which said stems extend.

The invention further seeks to provide such a fabric wrapped vertical blind and wherein said attachments further include clips engaging said upper edges of said blind slats on either side of said opening.

The invention further seeks to provide such a fabric wrapped vertical blind, and including a reinforcing tape secured along an upper edge of said panel, and fasteners attached to said tape at spaced intervals therealong, said fasteners being interengageable with said attachments for securing said fabric panel as aforesaid.

The invention further seeks to provide such a fabric wrapped vertical blind, wherein said fabric panel is located on one side only of said blind slats, and partially enfolds each said blind slat.

The invention further seeks to provide such a fabric wrapped vertical blind, wherein said fabric panel is formed of light permeable material, whereby to permit passage of light from the exterior to the interior, while providing privacy from the exterior.

The invention further seeks to provide such a fabric wrapped vertical blind wherein said fabric panel defines a vertical edge and wherein said vertical edge is secured along the length of a said blind slat.

The invention further seeks to provide such a fabric wrapped vertical blind wherein flexible suspension filaments are secured to said upper edge of said fabric panel, being located in pairs between each said fold of said panel, said elements extending over the upper end of a respective said blind slat, and locating notches in said upper end of each said blind slat.

The invention further seeks to provide such a fabric wrapped vertical blind wherein said upper edge of said fabric panel, in each said fold, is sewn together, in two spaced apart locations defining a space therebetween.

The invention further seeks to provide such a fabric wrapped vertical blind including frictional fabric gripping clips, said clips being clipped over said upper edges of said folds and over said upper edges of said blind slats.

The invention further seeks to provide such a fabric wrapped vertical blind including fastening pins passing through said upper edges of respective said folds in said fabric panel, and engaging said upper edge of each respective said blind slat.

The invention further seeks to provide such a fabric wrapped vertical blind wherein each said fold is attached to its respective said blind slat in a single location, said location being off centre with respect to a central axis of said blind slat.

The invention further seeks to provide a fabric wrap kit for attachment to the blind slats of a vertical blind, and having a fabric panel, a reinforcement along an upper edge of said panel, fastenings on said reinforcement; a plurality of fabric panel attachments for securing on said slats of said blind, said attachments being interengageable with said fastenings on said reinforcement to secure said fabric panel on said blind slats.

The invention further seeks to provide a fabric wrap kit for attachment to the blind slats of a blind, wherein said blind is a vertical blind, and wherein said fastenings comprise friction pressure-engagement type fasteners, and said attachments on said reinforcement are adapted to receive said fasteners, in releasable engagement.

The invention further seeks to provide a fabric wrap kit for attachment to the blind slats of a vertical blind wherein said attachments for said blind slats comprise clip portions shaped to fit on the upper edges of said blind slats, in spaced apart relation, and fasteners receiving recesses in said attachments for frictional reception and retention of said fasteners.

The invention further seeks to provide a fabric wrap kit for attachment to the blind slats of a vertical blind and wherein said blind has a head rail and trolleys carried in said head rail, and stems extending down from said trolleys, said stems defining slits for reception of said blinds therein, and wherein said clips are formed with fingers adapted to interlock in said slits whereby to secure said clips on said blinds.

The invention further seeks to provide a fabric wrap kit for attachment to the blind slats of a vertical blind and including hook formations of said fingers, said hook formations adapted to interlock with one another.

The invention further seeks to provide a fabric wrap kit for attachment to the blind slats of a vertical blind wherein said fingers and said hook formations are shaped and adapted to pass at least partially through said slits in said stems and interlock as aforesaid.

The various features of novelty that characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

BRIEF DESCRIPTION OF THE DRAWINGS

FIG. 10 is perspective view of a further embodiment;

FIG. 11 is an enlarged partially exploded view of FIG. 10;

DESCRIPTION OF A SPECIFIC EMBODIMENT

Figure 1:
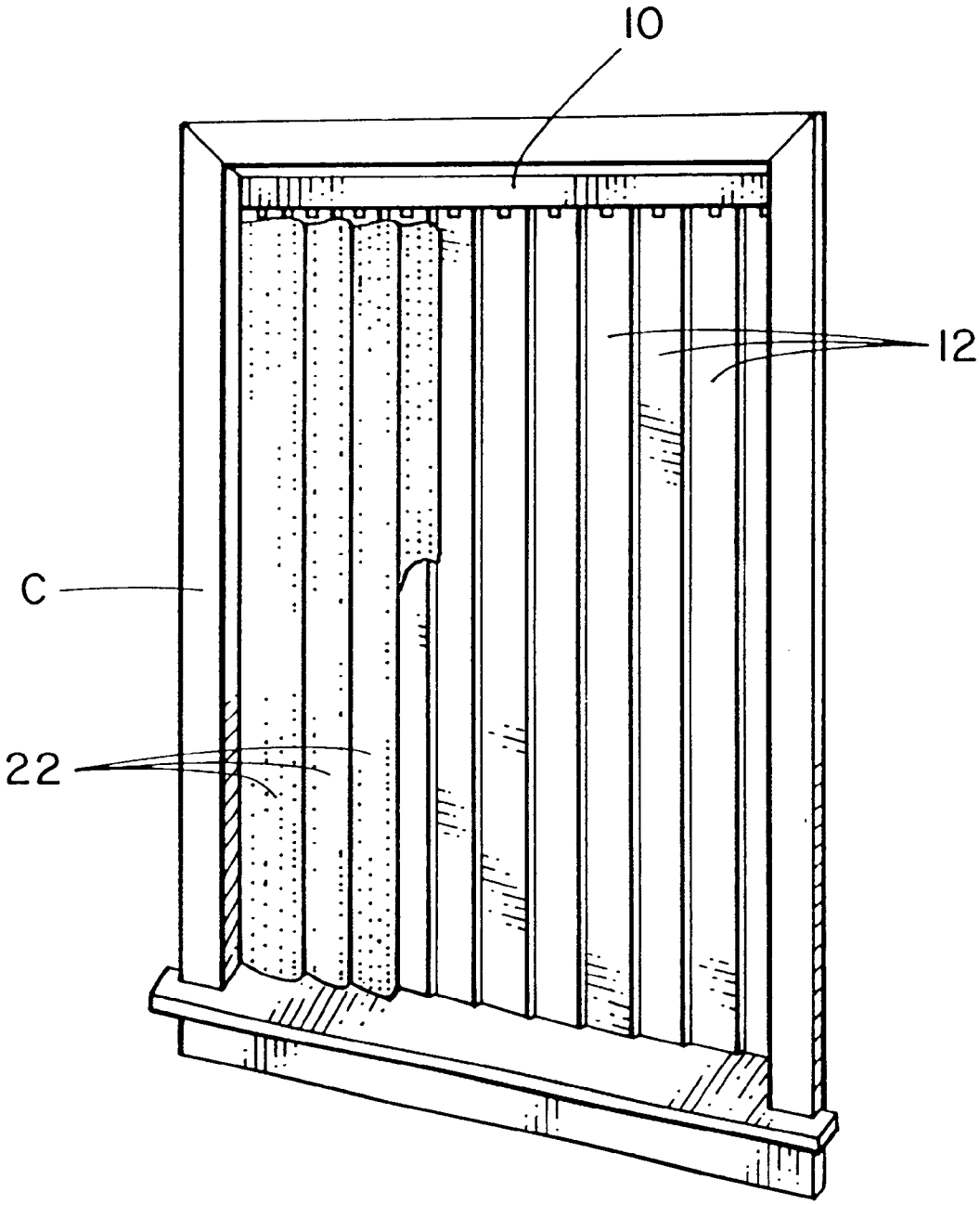
FIG. 1 is a perspective view of a typical vertical blind of the type that may be fitted with a fabric wrap or shroud for the purpose of illustration the invention.

Referring first to FIG. 1 this illustrates in general terms a typical vertical blind of the type to which the invention relates. Such a blind 10 has a head rail 12 secured usually within the frame of the doorway or window opening, and has a plurality of blind slats 12 suspended by their upper ends from the head rail 10. Within head rail 10 there are a series of travellers or trolleys 14 (FIG. 2) which run along the interior of head rail 10. This enables the slats to be extended across the opening, or drawn to one side, somewhat in the manner of a drape, as desired.

Travellers 14 are formed with dependent stems 16 which are slit as at 18 so as to receive and grip the upper edge of each blind slat 12. Typically the stems 16 are formed with tooth like formations (not shown) within the slits 18 for engaging the upper edge of the slats. The slats are formed with openings (not shown) for receiving the teeth on the stem 16.

The stems 16 are connected to rotation mechanism (not shown) within travellers 14. When the slats are drawn across the window or door the slats can be rotated, by the operation of controls C, between open and closed positions. All this is well known and is mentioned here only for the sake of explanation of the invention.

Figure 2:
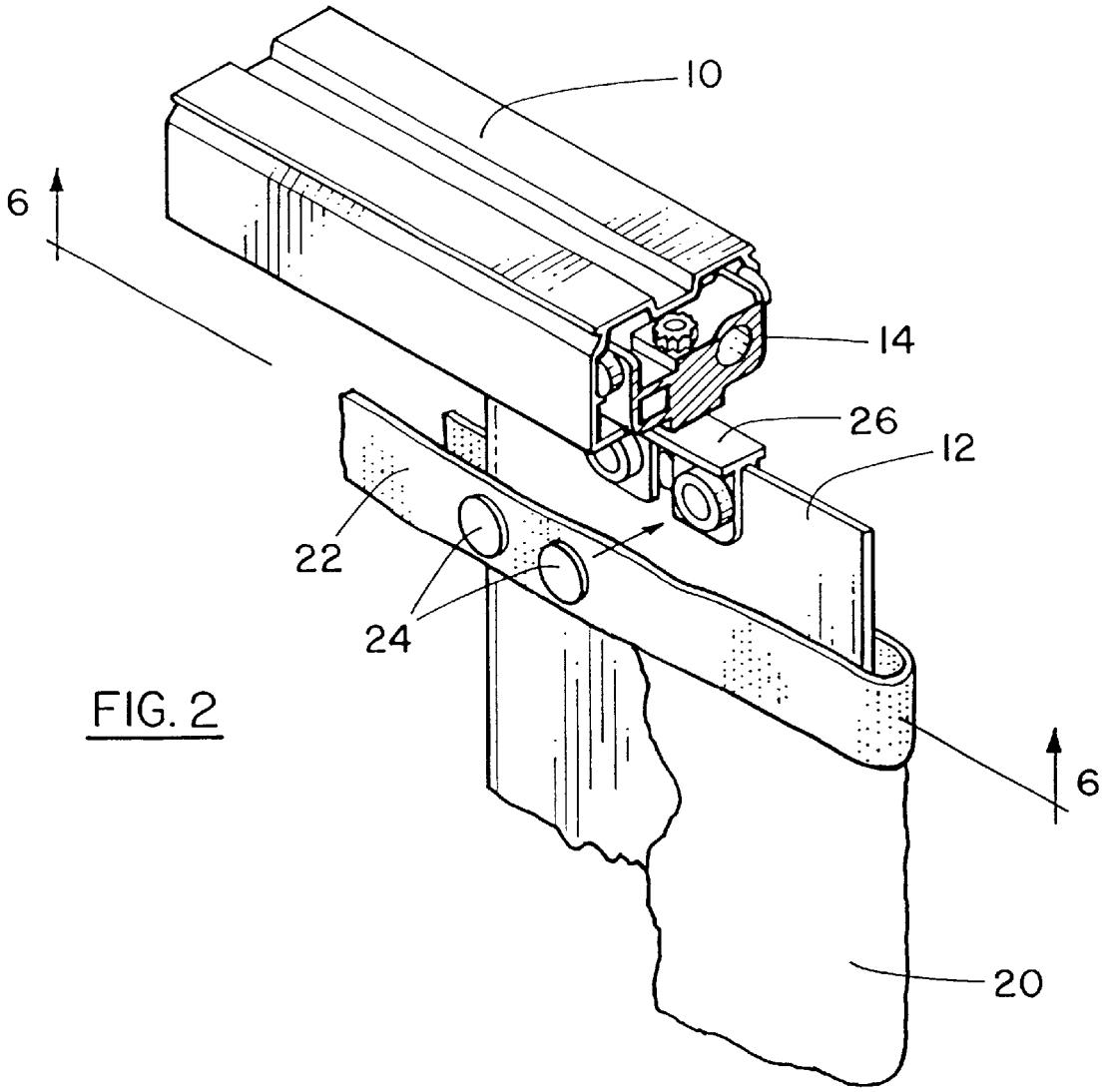
FIG. 2 is a perspective view partially cut away showing the head rail and traveller and one blind slat with the fabric wrapped therearound.
Figure 6:
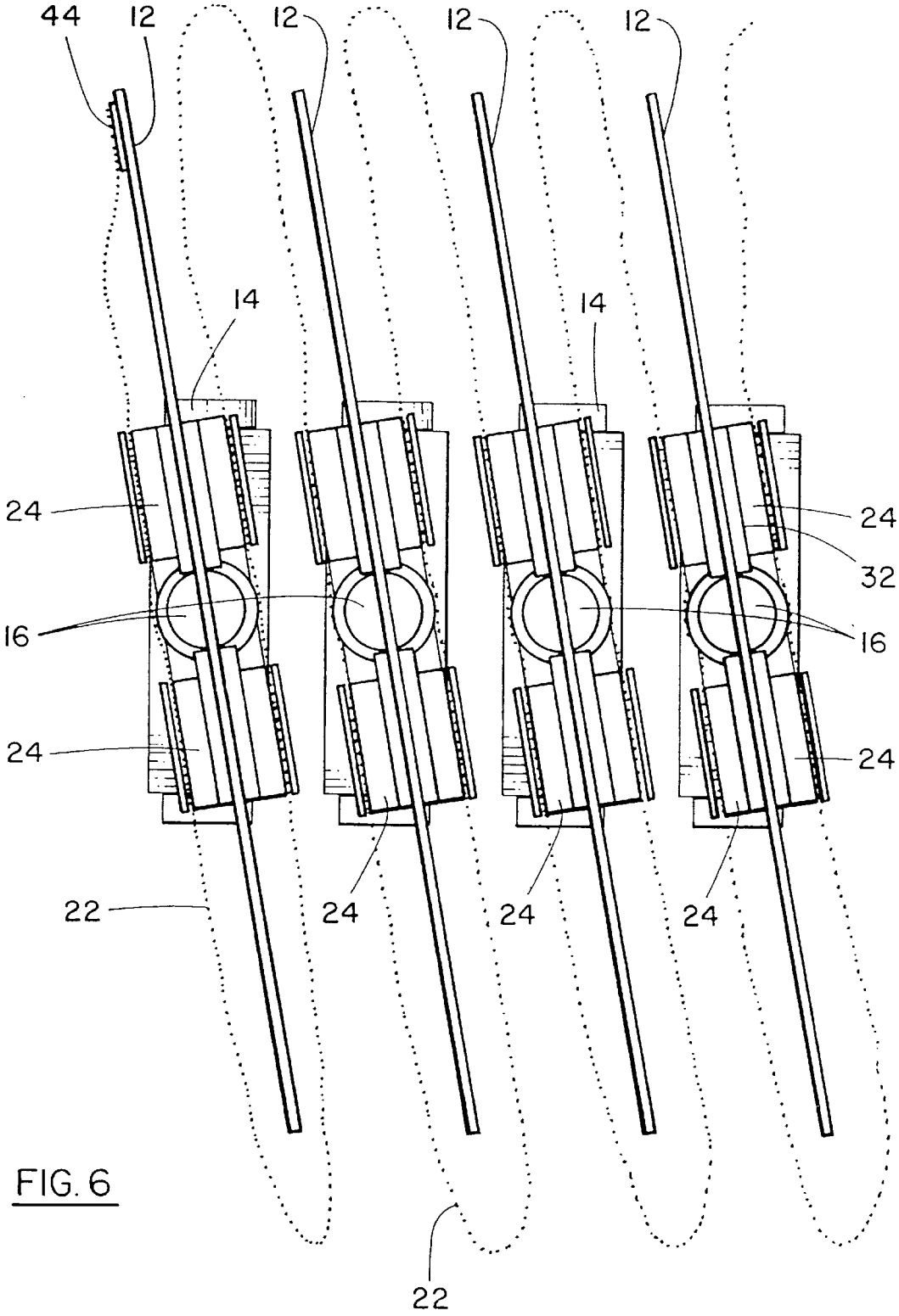
FIG. 6 is an enlarged section along the line 6—6 of FIG. 2 showing a group of blind slats, rotated into their open position and drawn to one side, and showing the clip devices holding the fabric in position.

As discussed above for various reasons, both simply for aesthetics, and for greater privacy, it is considered desirable to combine a form of shear drape with the blind. One embodiment of such a shear or fabric panel wrap is shown in FIGS. 2 and 6. In this embodiment the blind slats 12 are themselves partially wrapped, between folds of fabric 20. The fabric 20 is in fact a continuous panel of fabric, which, depending upon the width of the fabric may, and usually will be, two or more fabric panels sewn or seamed to form a continuous panel. Along the upper edge of fabric panel 20 there is preferably a reinforcement tape 22, typically being simply sewn to the upper edge of fabric 20. At spaced intervals along tape 22 there are pairs of friction fasteners 24—24 at predetermined spacings, for reasons described below.

Figure 3:
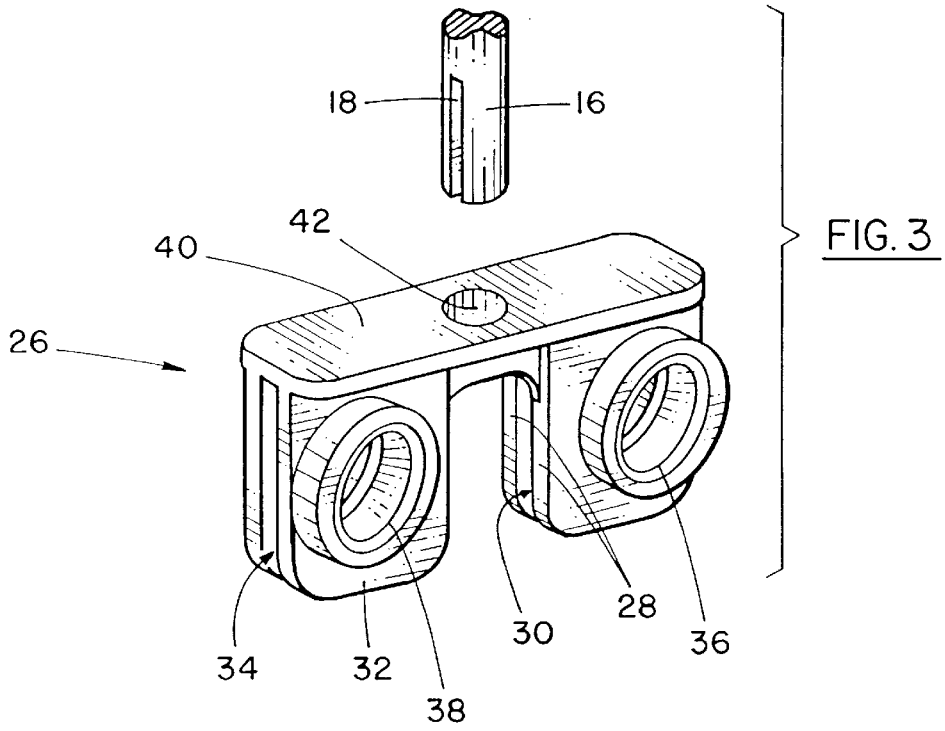
FIG. 3 is an exploded perspective view of the stem portion of the traveller, and the clip for holding the fabric.
Figure 4:
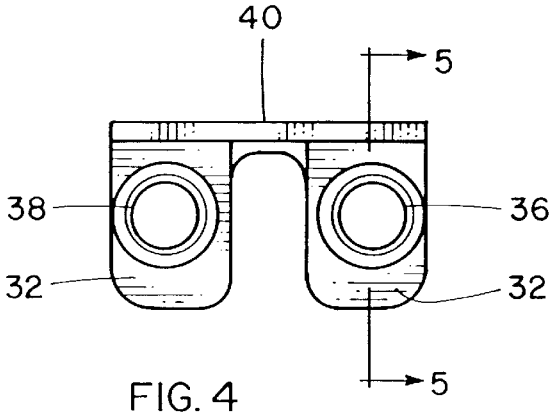
FIG. 4 is a side elevation view of a clip.
Figure 5:
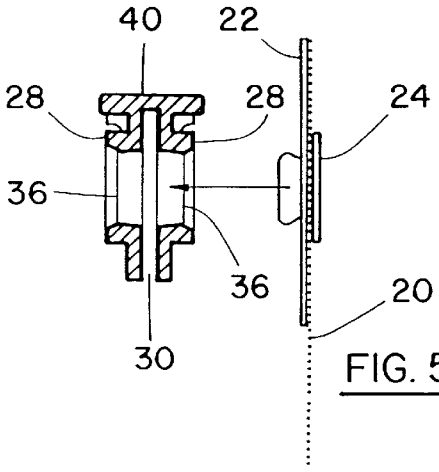
FIG. 5 is a section along the line 5—5 of FIG. 4.

Mounted on the top or upper edge of each blind slat 12 there are, in this embodiment, fabric panel attachments, in the form of clips 26. Each clip 26 (FIGS. 3, 4 and 5) comprises a first pair of flattened attachment flanges 28, formed spaced apart from one another by a slit 30 designed to receive the upper edge of a blind slat 12. Clip 26 further comprises a second pair of generally flattened attachment flanges 32, separated by a slit 34, designed to receive the upper edge of a blind slat 12. Both pairs of flanges 28 and 32 are formed with fastener receiving recesses 36 and 38 respectively. Recesses 36 and 38 are dimensioned to receive friction fasteners 24 on tape 22.

In this embodiment the two pairs of flanges 28 and 32 are integrally joined together by a bridge 40. Bridge 40 is formed with a central through bore 42.

Bore 42 is sized to receive stem 16 of a traveller 14. The stem 16 is longer than the depth of bridge 40 so that the lower end of stem 16 extends clear of bore 42. This enables the stem 16 to be fitted onto the upper edge of blind slat 12.

In the case of this embodiment the stem 16 has a slit 18 provided with teeth (not shown) which engage with a suitable opening (not shown) in the upper edge of the blind slat and hold it securely suspended. These features of the stem and the blind slat form no part of the invention and description is believed to be superfluous.

There may be other forms of stem and other forms of engagement with the blind slat, and the invention is equally applicable to such other forms of blind design with minor modifications.

In the use of this embodiment the fabric 20 is attached to the attachment clips 26 so as to form a series of folds or partial wraps. Each fold will partially enclose one blind slat, extending around one vertical edge of the blind slat but leaving the other vertical edge free. Thus a first pair of fasteners 24 will be snapped into the receiving recesses 36 and 38 on one side of a blind slat 12.

The fabric will be wrapped around the blind slat and the next two fasteners will be snapped into the corresponding recesses 36 and 38 on the opposite side of the same blind slat. The fabric will then be folded back into a loose pleat so that the next pair of fasteners 24 can be snapped into the next adjacent pair of recesses 36 and 38, on the next adjacent blind slat 12. The fabric is again partially wrapped or folded around that blind slat and the next pair of fasteners 24 are snapped into their recesses 36 and 38 on the next side of that blind slat.

The process is repeated until the tape is fully attached to the blind slats. This will leave the fabric 20 hanging loosely down forming a series of folds folding partially around each of the blind slats in turn. When the blind slats 12 are drawn to one side, the fabric 20 will fold in between adjacent blind slats. When the blind slats are drawn extended across the head rail to cover to opening of the door or window, the fabric 20 will become extended. However since the fabric 20 is wider than the width of the opening of the door or window, the fabric will still form loose folds. This will give a pleasing aesthetic appearance, while allowing light to pass through into the interior. The fabric panel of sheer material will provide privacy for those inside, in much the same way as would a shear drape, even when the slats are rotated open.

When the slats are rotated closed, no light, or no significant light will pass, or it may be nightime, when greater privacy may be desired. In this case the fabric panel will form a shear drape hanging in loose folds which may provide a more pleasant aesthetic appearance than the sight of the blind slats themselves.

Typically the ends of the fabric panel may be attached to the vertical edges of the leading and and trailing blind slats by adhesive strips 44 (FIG. 6).

Figure 7:
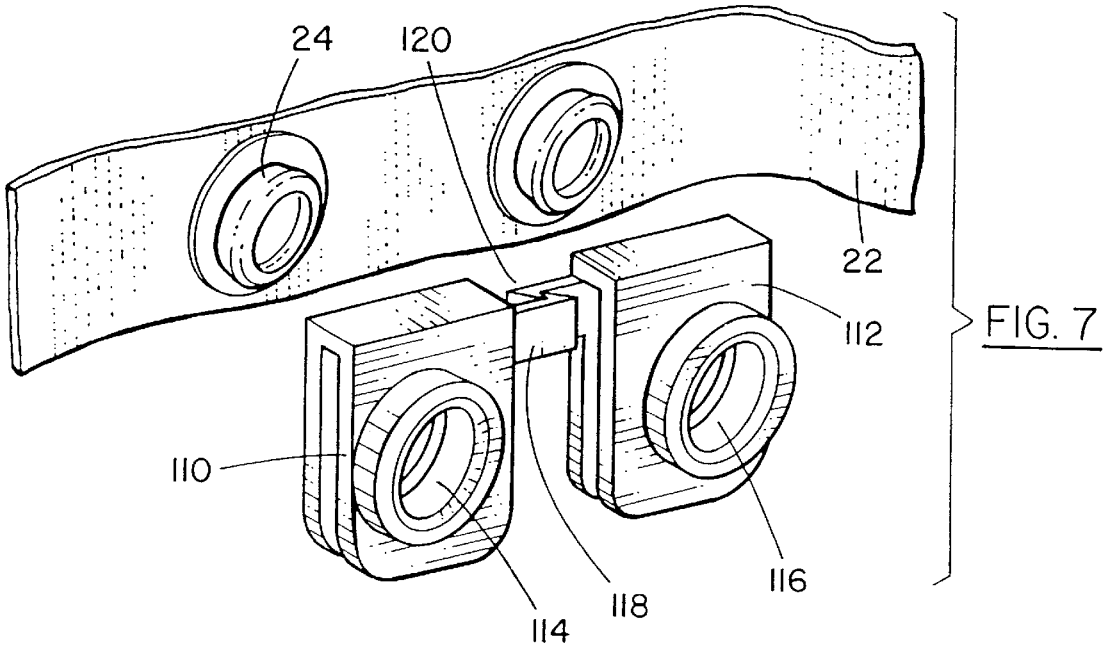
FIG. 7 is an exploded view of an alternate embodiment of the invention for retrofitting an existing vertical blind with a fabric wrap.
Figure 8:
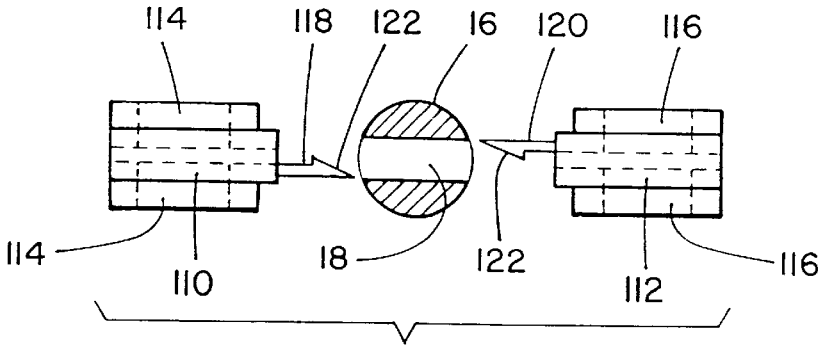
FIG. 8 is an exploded bottom plan view of the embodiment of FIG. 7 showing the interlocking of two clips with a stem from a traveller.
Figure 9:
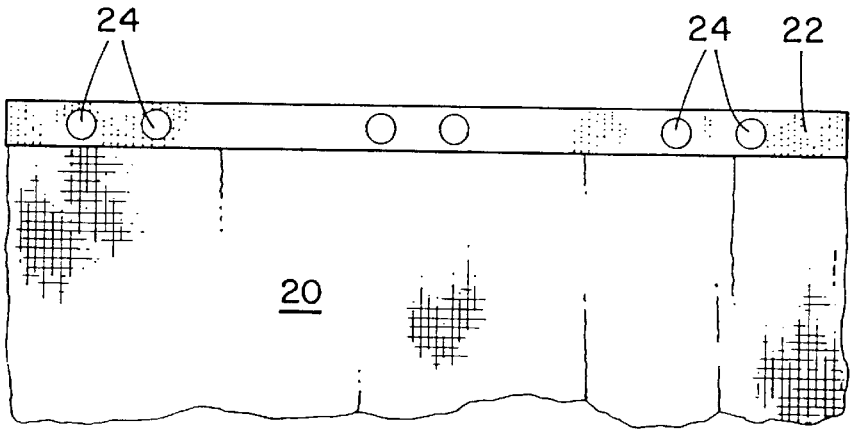
FIG. 9 is a perspective view of an upper portion of the fabric wrap showing the top edge of the fabric and tape and a series of attachment devices.

Referring now to FIGS. 7, 8, and 9 another embodiment of the invention is illustrated, for use in retrofitting existing vertical blinds, so that they may enjoy the same improved appearance, and privacy as described above without the need for discarding the old blind and buying a new one.

In this embodiment, the blind head rail 10 blind slats 12 and travellers 14, as shown in FIG. 1, with rotatable stems 16, suspending the blind slats 12, are all preexisting in a location which may be a home, or commercial location.

In order to retrofit such a blind with a fabric wrap, two pairs of clips 110 and 112 are provided, having fastener recesses 114 and 116 on each side. Clips 110 and 112 are separate from one another, in this embodiment, and are each formed with interlock fingers 118 and 120 respectively.

Fingers 118 and 120 are located on the sides of clips 110 and 112, which abut against traveller stems 16. Stems 16 are part of the existing travellers forming part of the typical vertical blind, similar to those of the earlier embodiment, and are therefor slit to receive the blind slat therein.

Fingers 118 and 120 are so dimensioned that they may be slid into the slit in the stem 16. Fingers 118 and 120 have hooks or tooth formations 122 thereon which interlock with one another when they are pushed into the slit in the stem 16 from either side (FIG. 8) and thus prevent withdrawal.

The kit will thus consist of the fabric panel 20 and a set of clips 110 and 112. In use the purchaser of the fabric wrap kit will first of all attach pairs of clips 110 and 112 on the upper edge of each blind slat. He will slide the clips towards opposite sides of stem 16. This will cause fingers 118 and 120 to slide into the slit in the stem 16, and become locked therein.

Once all the clips are locked in position he then simply attaches the fabric panel 20, to which is already sewn the tape reinforcement 22, by pressing the fasteners 24 on the tape 22, into the recesses 114 and 116 in the clips 110 and 112, in exactly the same way as described above.

The end result will be a vertical blind with a fabric wrap partially wrapping around one edge of each blind slat and acting in the same way as described above.

Various other embodiments are considered within the scope of the invention.

For example, FIGS. 10 and 11 illustrate a fabric panel 130 having flexible ties or links 132–134 attached spaced apart between adjacent folds of the panel. Such ties or links could be threads or cords or flexible wire loops. They simply loop over the upper edges of the slats. The slats are provided with notches 136 to receive the ties or links.

One of the ties in each pair could be releasable and attachable so as to permit the panel to be attached to an existing vertical blind, without removal of the blind slats.

Figure 12:
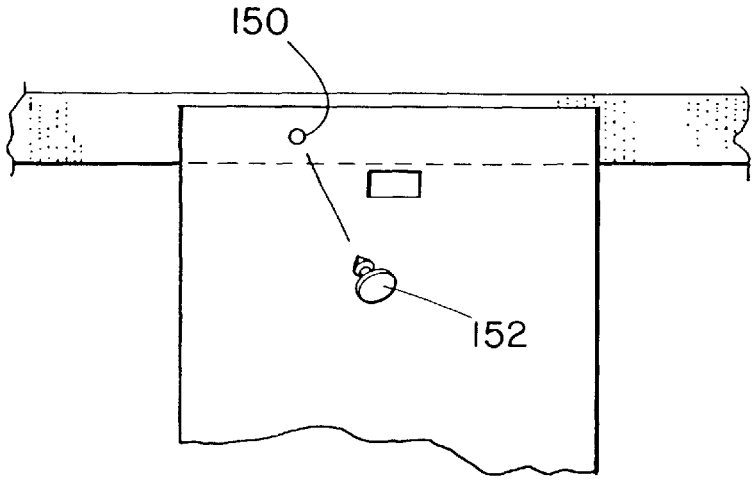
FIG. 12 is a side elevation of a further embodiment, partially exploded.

FIG. 12 illustrates an embodiment in which the fabric panel may be attached and hung "off-centre". For this purpose a blind slat is formed with a single opening 150, to one side of is centre line. The fabric panel can be attached by a fastening pin 152, which passes through openings in the reinforcement strip and through opening 150 in the blind slat.

This will cause the fabric panel folds to hang with their centres of gravity tending to pull the folds closer around the blind slats.

Figure 13:
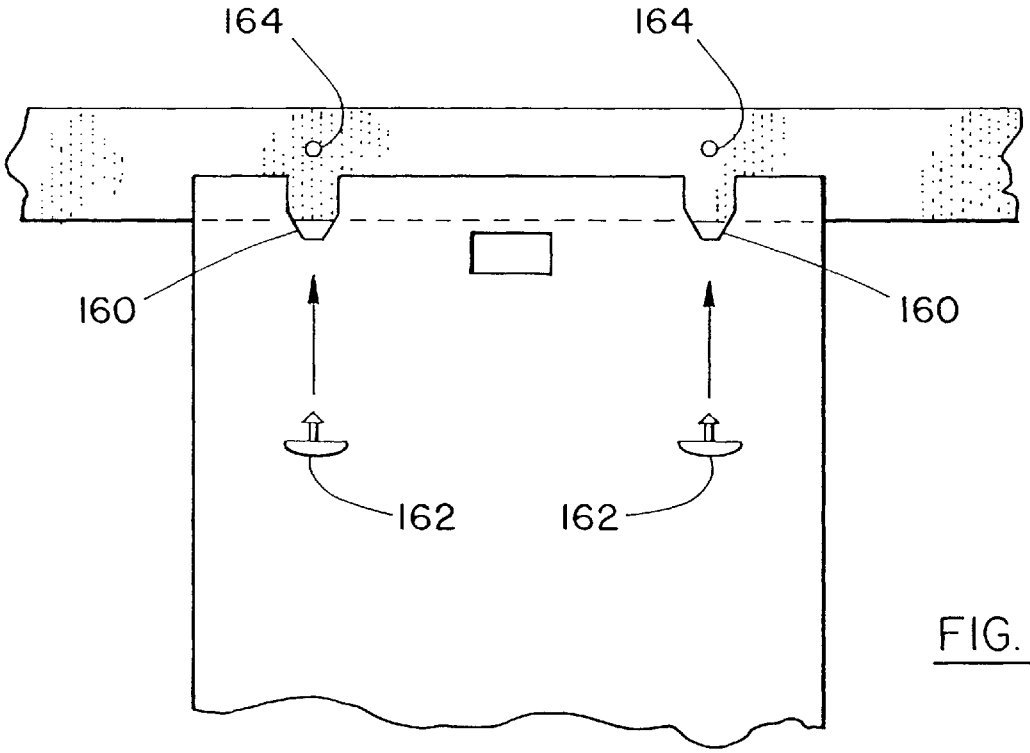
FIG. 13 is a side elevation of a further embodiment, partially exploded.

FIG. 13 illustrates an embodiment similar to FIG. 12, but in this case there are two notches 160 spaced apart along the upper edge of the blind slat. Two pins 162 pass though two openings 164 in the panel. In this case the panel is suspended on both sides of the centre line of each slat.

Figure 14:
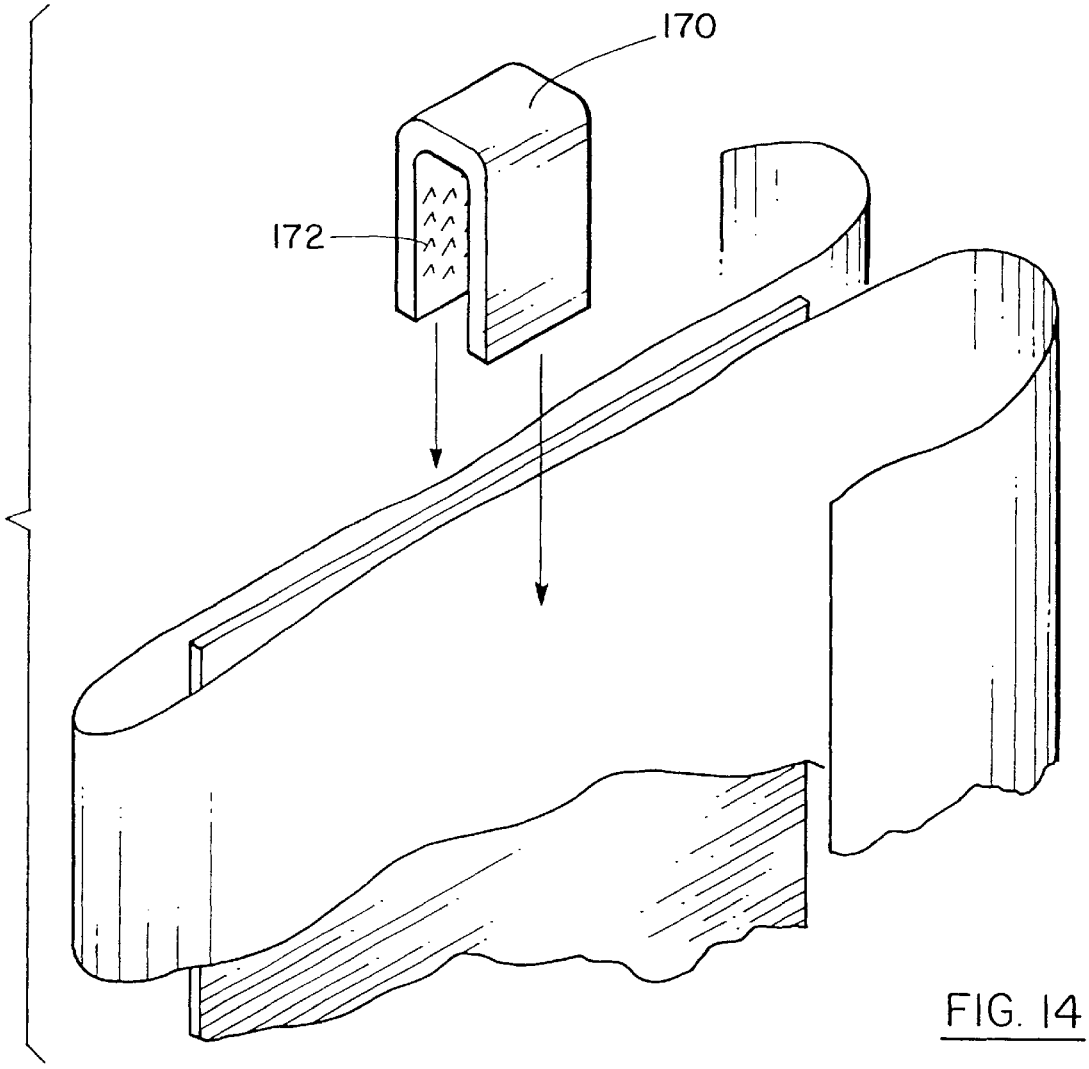
FIG. 14 is a perspective view of a further embodiment partially exploded; and, FIG. 15 is a perspective of a further embodiment.

FIG. 14 shows another embodiment. In this case the folds of the panels are attached to the upper edges of the slats by pairs of clips 170, of generally U-shaped construction. Clips 170, one of which is shown opened up for clarity, would be moulded or formed so that they were closed up to provide a good frictional grip on the fabric. The clips are of U-shaped construction and have interior teeth 172 for gripping the fabric. For the sake of clarity only one such clip is illustrated, but it will be understood that they will be secured in pairs, extending over the upper edge of the fabric and of the blind slat, two per blind slat, one on each side of the centre, in order to provide a secure grip on the fabric panel.

Figure 15:
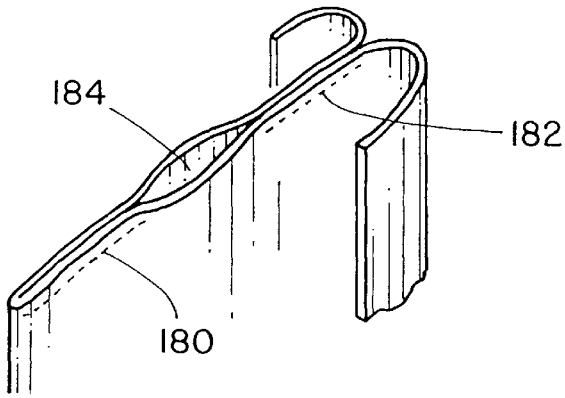

FIG. 15 shows another embodiment. In this case the folds of the panel are pre-formed.

The top edges of the folds are sewn together as at 180 and 182, leaving an opening 184 therebetween. During manufacture the stems of the trolleys can be slid through the openings 184 and the folds of fabric will hang down and envelop each slat.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A fabric wrapped vertical blind having a head rail, a plurality of trolleys being movable along the head rail and a plurality of blind slats being suspended therefrom, in which the plurality of blind slats can be moved with the plurality of trolleys along the head rail and rotated open or closed, each of the plurality of blind slats has an upper end and two sides, the fabric wrapped vertical blind comprising:

a fabric panel defining an upper edge and folds in said fabric panel for receiving one of the plurality of blind slats in said folds;

a plurality of panel clips being mounted on the upper end to straddle over and hang on both sides of said upper end of each of the plurality of blind slats;

a plurality of panel clip attachments being on said upper edge of said fabric panel for securing said folds to said plurality of panel clips, said folds being secured by said plurality of panel clip attachments and said plurality of panel clips to said upper end of each of the plurality of blind slats, wherein each of said folds at least partially enfolds each of the plurality of blind slats.

2. The fabric wrapped vertical blind as claimed in claim 1, wherein said plurality of panel clips comprise a plurality of friction fasteners incorporated in said plurality of panel clips, and wherein said plurality of panel clip attachments further comprise a plurality of complementary friction connectors for engaging said plurality of friction fasteners in said plurality of panel clips.

3. The fabric wrapped vertical blind as claimed in claim 2, wherein the plurality of trolleys moving in the head rail have a plurality of suspension stems extending down from the plurality of trolleys, said plurality of suspension stems engaging the plurality of blind slats, said plurality of panel clips defining body portions and an opening through which said plurality of suspension stems extend.

4. The fabric wrapped vertical blind as claimed in claim 3, wherein said plurality of panel clips engage the upper end of the plurality of blind slats on either side of said opening.

5. The fabric wrapped vertical blind as claimed in claim 1, further comprising a reinforcing tape being secured along an upper edge of said fabric panel, said plurality of panel clip attachments being connected to said reinforcing tape for securing said fabric panel to each one of said plurality of blind slats.

6. A fabric wrapped vertical blind as claimed in claim 1, wherein said fabric panel is located on one side only of said blind slats, and partially enfolds each said blind slat around one edge thereof.

7. A fabric wrapped vertical blind as claimed in claim 1, wherein said fabric panel is formed of light permeable material to permit passage of light from the exterior to the interior, while providing privacy from the exterior.

8. A fabric wrapped vertical blind as claimed in claim 1, wherein said fabric panel defines a vertical edge, and wherein said vertical edge is secured along the length of a said blind slat.

9. The fabric wrapped vertical blind as claimed in claim 1, further comprising one or more frictional fabric gripping clips adjacent to the plurality of trolleys, said one or more frictional fabric gripping clips being clipped over said upper edge and over the upper end.

10. A fabric wrap kit for mounting to an upper end and two sides of a plurality of blind slats of a vertical blind, the vertical blind having a head rail and a plurality of trolleys, the plurality of trolleys moving in the head rail for carrying the plurality of blind slats, the fabric wrap kit for converting the vertical blind into one having a fabric wrapped around the plurality of blind slats, the fabric wrap kit comprising:

a fabric panel;

a plurality of panel clip attachments along an upper edge of said fabric panel;

a plurality of panel clips mounted on the upper end to straddle over and hang on both sides of the upper end of each of the plurality of blind slats, said plurality of panel clips being interengageable with said plurality of panel clip attachments on said fabric panel to secure said fabric panel in folds on the plurality of blind slats.

11. The fabric wrap kit as claimed in claim 10, wherein said plurality of panel clips comprise a plurality of friction pressure-engagement fasteners, and wherein said plurality of panel clip attachments on said fabric panel interengage with said plurality of friction pressure-engagement fasteners in releasable engagement.

12. The fabric wrap kit as claimed in claim 11, wherein said plurality of panel clips for the plurality of blind slats comprise clip portions being shaped to straddle over and hang on a pair of sides of the upper end of the plurality of blind slats, in spaced apart relation adjacent the plurality of trolleys, wherein said plurality of friction pressure-engagement fasteners and said plurality of panel clip attachments are interengageable with respect to one another for securing said fabric panel to said plurality of panel clips.

13. The fabric wrap kit as claimed in claim 12, wherein the plurality of trolleys have a plurality of stems extending down from the plurality of trolleys, said plurality of stems defining a plurality of slits for reception of the plurality of blind slats therein, and wherein said plurality of panel clips are formed with fingers adapted to interlock with one another when said fingers of two adjacent panel clips of said plurality of panel clips are slid into overlapping engagement in said plurality of slits to secure said plurality of panel clips on said plurality of blind slats.

14. A fabric wrap kit for attachment to the blind slats of a vertical blind as claimed in claim 13, further comprising hook formations of said fingers, said hook formations being adapted to interlock with one another when said fingers are slid alongside one another as aforesaid.

15. A fabric wrap kit for attachment to the blind slats of a vertical blind as claimed in claim 14, wherein said fingers and said hook formations are shaped and adapted to pass at least partially through said slits in said stems and interlock as aforesaid.

16. A fabric wrap kit for attachment to the blind slats of a vertical blind as claimed in claim 10, further comprising a reinforcing strip attached a along an upper edge of said fabric panel, wherein said fastenings are secured to said reinforcing strip.

17. A fabric wrapped vertical blind having a head rail, plurality of trolleys being movable along said head rail and a plurality of blind slats being suspended therefrom, in which the plurality of blind slats can be moved with the plurality of trolleys along the head rail and rotated open or closed, the plurality of blind slats have an upper end and two sides, the fabric wrapped vertical blind comprising:

a fabric panel defining an upper edge and folds in said fabric panel for receiving one of the plurality of blind slats;

a plurality of panel clips being mounted on the upper end to straddle over and hang on both sides of the upper end of each of the plurality of blind slats;

one or more friction fasteners being incorporated in said plurality of panel clips; and one or more complementary friction connectors being on said upper edge of said fabric panel and said folds in said fabric panel being secured by said friction connectors to said friction fasteners on each of said plurality of blind slats, said folds at least partially enfolding the plurality of blind slats.

18. A fabric wrapped vertical blind having a head rail, a plurality of trolleys movable in said head rail, and a plurality of blind slats being suspended therefrom, in which the plurality of blind slats can be moved with the plurality of trolleys along the head rail and rotated open or closed, the plurality of blind slats having an upper end and two sides, the fabric wrapped vertical blind comprising:

a fabric panel defining an upper edge and folds in said fabric panel for receiving one of the plurality of blind slats;

a plurality of panel clips being mounted on the upper end to straddle over and hang on both sides of said upper end of each of the plurality of blind slats;

one or more friction fasteners being incorporated in said plurality of panel clips;

one or more complementary friction connectors on said fabric panel securing said folds to the upper end of the plurality blind slats by engaging said friction fasteners; and a plurality of suspension stems extending down from the plurality of trolleys and engaging the plurality of blind slats and said plurality of panel clips each defining a body portion and an opening in said body portion through which said plurality of suspension stems extend, wherein said plurality of panel clips are positioned on said plurality of blind slats by said plurality of suspension stems and hang on said upper end of each of the plurality of blind slats.

19. A fabric wrapped vertical blind having a head rail, a plurality of trolleys being movable along said head rail, and a plurality of blind slats being suspended therefrom, in which the blind slats can be moved with the plurality of trolleys along the head rail and rotated open or closed, each of the plurality of blind slats defining an upper end, the fabric wrapped vertical blind comprising:

a fabric panel defining an upper edge and folds in said fabric panel for receiving one of the plurality of blind slats in said folds;

a plurality of panel clips being mounted on the upper end to straddle over and hang on both sides of the upper end of each of the plurality of blind slats;

a plurality of friction fasteners being incorporated in said plurality of panel clips;

one or more complementary friction connectors being on said fabric panel securing said folds to the upper end of the plurality of blind slats by engaging said friction fasteners;

a plurality of stems extending down from the plurality of trolleys, said plurality of stems defining one or more stems slits for reception of each of the plurality of blind slats;

one or more fingers being formed on said plurality of panel clips for interlocking with one another when said one or more fingers of two adjacent panel clips of said plurality of panel clips are slid into overlapping engagement in said one or more stem slits, wherein said plurality of panel clips straddle over and hang on each side of the plurality of blind slats.

20. A fabric wrapped vertical blind having a head rail, a plurality of trolleys being moveable along said head rail and a plurality of blind slats being suspended therefrom, in which the plurality of blind slats can be moved with the plurality of trolleys along the head rail and rotated open or closed, the plurality of blind slats defining an upper end, two sides and one or more slots being formed in each of the plurality of blind slats for attachment to the plurality of trolleys, the fabric wrapped vertical blind comprising:

a fabric panel defining an upper edge and having folds for receiving the plurality of blind slats in said folds;

a fastening strip being secured along said upper edge;

one or more openings further comprising one or more upwardly directed U-shaped notches in each of the plurality of blind slats being adjacent said one or more slots and spaced therefrom; and one or more panel fastenings passing through said fastening strip and through said one or more openings, said one or more panel fastenings securing said folds to the plurality of blind slats with said folds at least partially enfolding the plurality of blind slats.

21. A fabric wrapped vertical blind having a head rail, a plurality of trolleys being moveable along the head rail and a plurality of blind slats being suspended therefrom, in which the plurality of blind slats can be moved with the plurality of trolleys along the head rail and rotated open or closed, the plurality of blind slats defining an upper end, the fabric wrapped vertical blind comprising:

one or more flexible suspension filaments being secured to an upper edge of a fabric panel having folds, said one or more flexible suspension filaments being located in pairs between each fold of said fabric panel, said flexible suspension filaments extending over the upper end; and one or more locating notches in the upper end for receiving said one or more flexible suspension filaments in said folds, wherein said locating notches join with said one or more flexible suspension filaments to join said fabric panel to the plurality of blind slats.

22. A fabric wrapped vertical blind system comprising:

a plurality of blind slats each having an upper edge and two sides;

a fabric panel having an upper end and folds in the fabric panel for receiving and at least partially enfolding each of the plurality of blind slats;

a plurality of panel clips, each mounted to the upper edge of each of the plurality of blind slats to straddle over and hang on both sides of the upper edge of each of the plurality of blind slats, and a plurality of panel clip attachments being on the upper end of the fabric panel for securing the folds of the fabric panel to each of the plurality of panel clips on each of the plurality of blind slats.

23. A fabric wrap kit for retrofitting a plurality of blind slats having an upper edge and two sides, comprising:

a fabric panel having an upper end and folds in the fabric panel for receiving, and at least partially enfolding each of the plurality of blind slats;

a plurality of panel clip attachments being on the upper end of the fabric panel; and a plurality of panel clips, each mounted to the upper edge of each of the plurality of blind slats to straddle over and hang on both sides of the upper edge of each of the plurality of blind slats;

wherein the plurality of panel clip attachments engage each of the plurality of panel clips on each of the plurality of blind slats for securing the folds of the fabric panel to the plurality of blind slats.

* * * * *